US006889732B2

(12) United States Patent
Allen

(10) Patent No.: US 6,889,732 B2
(45) Date of Patent: May 10, 2005

(54) NO-SPILL, VAPOR-RECOVERY, CONTAINER SPOUT

(76) Inventor: Clifford Harry Allen, 13109 Westchester trail, Chesterland, OH (US) 44026

( * ) Notice: Subject to any disclaimer, the term of this patent is extended or adjusted under 35 U.S.C. 154(b) by 0 days.

(21) Appl. No.: 10/634,167

(22) Filed: Aug. 5, 2003

(65) Prior Publication Data

US 2004/0025968 A1 Feb. 12, 2004

Related U.S. Application Data

(60) Provisional application No. 60/402,582, filed on Aug. 12, 2002.

(51) Int. Cl.[7] ..... B65B 1/04

(52) U.S. Cl. ..... 141/353; 141/59; 141/198; 141/255; 141/291; 141/366

(58) Field of Search ..... 141/192, 198, 141/255, 258, 264, 284, 285, 291, 296, 351, 353, 366, 391, 392; 222/566–571, 484, 514, 518, 525

(56) References Cited

U.S. PATENT DOCUMENTS 4,667,710 A 5/1987 Wu
4,834,151 A 5/1989 Law
5,076,333 A 12/1991 Law
5,228,487 A 7/1993 Thiermann et al.
5,249,611 A 10/1993 Law
5,419,378 A 5/1995 Law
6,318,604 B1 11/2001 Messner
6,478,058 B1 * 11/2002 Pears ..... 141/353
6,484,765 B1 * 11/2002 Clemmons et al. ..... 141/292

OTHER PUBLICATIONS

Consumer Reports Magazine, Jul. 2002, pp. 9 Author unknown, Title: No–spill gas cans.

* cited by examiner

*Primary Examiner*—Timothy L. Maust

(57) ABSTRACT

A vapor recovery spout for a portable fuel container. The spout includes an inner sleeve attached to the container to provide a fuel flow passage through the spout. The passage has an outlet port for fuel to flow through into a tank. A sliding sleeve is mounted on the inner sleeve for sliding axial movement from an outwardly extended position to a retracted position. A radially extending annular seal is mounted on the sliding sleeve for sealing the fuel tank opening when the spout is inserted. Vapor recovery passages are provided between the inner sleeve and the sliding sleeve for displaced vapor to flow from the tank to the container. The sliding sleeve closes the fuel passage and the vapor recovery passageways when in its extended position and opens the fuel passage and the vapor recovery passageways when in its retracted position. A spring urges the sliding sleeve to its extended position.

12 Claims, 4 Drawing Sheets

NO-SPILL, VAPOR-RECOVERY, CONTAINER SPOUT

CROSS-REFERENCE TO RELATED APPLICATIONS

This application claims the benefit of PPA Application No. 60/402,582, filed Aug. 12, 2002 by the present inventor.

FEDERALLY SPONSORED RESEARCH

Not Applicable.

SEQUENCE LISTING OR PROGRAM

Not Applicable.

BACKGROUND OF THE INVENTION

1. Field of Invention

This invention relates to spouts for portable gasoline containers which are used to re-fuel off-road power equipment such as tractors, lawn mowers, chainsaws, outboard motors, etc.

2. Background of the Invention

Gasoline spillage while refueling off-road power equipment is a frequent occurrence, and a source of irritation and worry to the operator, since gasoline is highly flammable and explosive. The presence of hot engine components adds to this concern. The problem arises from a combination of poor visibility of the rising fuel level in the vehicle fuel tank, combined with the operator's natural desire to finish the refueling as quickly as possible, while still filling the tank completely.

An increasing problem is the effect on air quality. The spilled fuel quickly evaporates, producing a volume of vapor several times larger than that of the spilled liquid fuel. The effect in a single case of spillage is small, but when multiplied by the large number of off-road gasoline-powered engines, some of which are refueled several times a day, the effects on air quality are significant.

Some states, notably California and Massachusetts, now require that portable gasoline containers sold in their states be un-vented, and equipped with an automatic shutoff spout which is spill-proof and able to capture fuel vapor as it is displaced from the fuel tanks of off-road, internal combustion engines by the incoming liquid fuel. It is predicted by some knowledgeable people in the industry that most states will follow with similar requirements within a few years.

Inventors have responded with various schemes to solve this problem. U.S. Pat. No. 6,318,604, to Messner et al depends upon a manual shut-off valve which fails to meet California's requirement of automatic shutoff. Spills can occur if the user does not release the valve when the tank is full and, as pointed out earlier, it is often difficult, under adverse lighting conditions, to observe the rapidly rising fuel level in the small openings found in most fuel tanks.

All of the prior art devices discovered rely upon developing a partial vacuum within the portable fuel container at some time during the re-fueling procedure. The resulting pressure differential, between atmospheric pressure and container pressure, is intended to support the head (weight) of the gasoline remaining in the container after the vent tube opening is blocked by rising fuel in the tank.

There are three serious limitations of partial container-vacuum systems, either or all, of which are characteristic of the prior art devices:

1. Devices which initiate the development of the partial vacuum after the fuel level reaches the vent tube entrance level can, and do, allow serious overfill spillage when the volume of air left in the container is large. Boyle's gas law states that in a closed system, at constant temperature, the absolute pressure of a gas, multiplied by its volume, is a constant. Application of this principle reveals that, when a gallon or more of fuel has been poured from the container, the volume of vapor and air mixture remaining in the container must be expanded as much as 5 to 8 cubic inches before a partial vacuum capable of stopping the flow of fuel is developed. This is especially true when an initial volume of vapor and air in the container, in addition to that of the poured fuel, is accounted for. This expansion requires an equal volume of fuel flow, and is a major reason why many of the prior-art devices fail to control spillage.
2. Attempts to avoid this problem by restricting the rate of vapor and air flow to the container while refueling, and thus to develop and maintain the partial vacuum during the entire time when the fuel is flowing, suffer from a different but equally annoying problem. Restriction of vapor and air flow to the container during refueling necessarily reduces the rate of fuel flow from the container. This slows refueling and is very tiring to a user holding the heavy container in an awkward position. Tests have revealed a flow rate as low as one gallon a minute with this type of device which is a burden when refueling a large garden tractor.
3. Open-system devices, which fail to seal the tank from the atmosphere, allow the vapor to follow the path of least resistance and, since it is lighter than air, it is free to move upward and out of the tank while the heavier air can move downward into the vicinity of the vent tube. This is even more likely to happen on a windy day, with the result that much of the air entering the vent tube may be atmospheric air rather than gasoline-vapor laden air. It is axiomatic that any vapor volume which is not allowed to return to the container must escape to the atmosphere with an open-system, sacrificing much of the initial purpose of the device. All of the prior art devices are open-system devices and thus fail under this criterion.

U.S. Pat. No. 5,228,487 to Thiermann et al was one device with which a flow rate of only one gallon per minute was recorded during tests. U.S. Pat. Nos. 4,834,151, 5,076,333, 5,249,611, and 5,419,378 to Law rely upon a capillary to restrict vapor flow to the container, yet these fail to prevent spills even with the restricted vapor flow and resulting decreased fuel flow rate. U.S. Pat. No. 6,318,604 to Messner et al is also an open-system device. It is axiomatic that any vapor volume which is not allowed to return to the container must escape to the atmosphere with an open system, sacrificing part of the initial purpose.

The California specifications require an un-vented container in order to reduce fuel vapor contamination of the atmosphere during storage of the container. On a hot day an un-vented container of gasoline can develop a high vapor pressure, especially if left sitting in the sun. To avoid a sudden surge of fuel into the tank and the danger of spillage when initiating the refueling process, the user of prior-art devices is cautioned to open the shutoff valve by hand while the container is still in the upright position, with the spout pointing away from the user, to release the pressurized vapor into the atmosphere. Obviously, this sacrifices again some of the initial purpose of the spout design.

While the vapor pressure is temporarily relieved by this action the container fuel is only partly cooled down. Container pressure will immediately build up again to the vapor pressure of the still-warm fuel. The possibility of creating a partial vacuum within the container of warm gasoline is certainly in question, and the probability of fuel spillage is again apparent.

The problems outlined above will occur with any device which relies on a partial container vacuum to stop fuel flow, and which allows the fuel tank opening to remain exposed to the atmosphere while refueling. Each of the prior art devices, which claim to provide spill-proof refueling of off-road power equipment, suffers from one or more of the deficiencies described above.

BACKGROUND OF INVENTION:—OBJECTS AND ADVANTAGES

Accordingly, the objects and advantages of my present invention are:

1. To provide a closed and sealed system consisting of the fuel container, the spout of the present invention, and the fuel tank, wherein the fuel flow is stopped by an increase in the vapor and air pressure in the tank, rather than by a decrease in the vapor and air pressure in the container.
2. To provide a spring-biased shutoff valve to automatically contain the fuel before the spout with its tank/seal is removed from the tank opening.
3. To provide a spring-biased, cone-shaped, spout/tank seal between the tank and the atmosphere, with a cone included angle preferably less than 90 degrees, which tends to be self-centering when it is applied to the tank opening. The range of cone diameters chosen for this seal gives it the capability of sealing all of the tank openings of off-road equipment from large tractors to small string trimmers.
4. To provide a spout/tank seal surface of rubber, or a rubber-like material, sufficiently resilient to establish a reliable seal with metal or plastic tanks used on off-road internal combustion engines. The latter often have square edged, sometimes poorly finished surfaces, which may or may not include some nicks or scratches.
5. To provide a vapor/air passageway having generous flow capacity to allow the vapor and air mixture, which is being displaced by the rising fuel level in the tank, to flow freely into the container. This maintains the container pressure nearly equal to the tank pressure increasing the flow rate of fuel to the tank and reducing the time required to fill the tank.
6. To provide a low flow-resistance check valve the purpose of which is to inhibit the intrusion of fuel into the vapor/air passageway while refueling. This low flow-resistance, in addition to the low flow-resistance of the vapor/air passageway, reduces the time required fill the tank as described under object 5 above.
7. To provide a flow rate of fuel to the tank which is even greater than the flow rate of a conventional vented fuel container by ensuring that the fuel conduit to the tank will always be full-flowing. This is a maximum-flow condition, developed when the conduit is filled completely and exclusively with fuel and the total head of fuel in the container is available to maximize the flow rate. This performance can not be achieved with a conventional vented gas can, because of the lack of a means to quickly stop the flow when the tank is nearly full, and it is not available with the prior-art devices described above without risk of spillage.
8. To provide a sealed cushion of trapped vapor and air in the tank after the rising fuel level has reached and covered the entrance to the vapor/air passageway. This cushion of trapped vapor and air absorbs the momentum of the rising fuel and, thereafter, maintains the static fuel level in the tank at a small fraction of an inch above the opening to the vapor/air passageway until the shutoff valve is closed with the removal of the spout with its tank seal and container.
9. To provide a biasing spring which is pre-compressed during assembly, with sufficient force to maintain a reliable spout/tank seal isolating the tank from the atmosphere under all conditions of usage, including the surge of fuel expected with the high-temperature, container vapor pressures described above.
10. To eliminate the need to release vapor and air to the atmosphere prior to applying the spout to the tank opening when high vapor pressures are present in the container.
11. To isolate the fuel and vapor from the atmosphere during the entire refueling process.
12. To provide a no-spill, vapor-recovery container spout, which utilizes and compresses a predictably small volume of vapor and air in the fuel tank to stop the flow of fuel. The predictably small size of this compressed volume determines the reliability of the spout and its convenience for the user.
13. To provide the above described spout with the capability of preventing fuel leakage in the event of the container being tipped over during transport.
14. To provide the option, if desired, of using a shield to guard against contamination of sliding-seal surfaces from dirty environments.

Other advantages which include improvements in air quality, dependability and in user convenience will become apparent in the ensuing discussion.

SUMMARY

As established by the present invention, a reliable, no-spill, automatic shutoff, vapor-recovery, rapid-flow pouring spout, adaptable to either an un-vented or vented portable fuel container, which prevents the escape of fuel or fuel vapor by sealing the tank opening from the atmosphere and recovering all of the vapor and air mixture displaced by the incoming fuel.

DRAWINGS:—FIGURES

DRAWINGS:—REFERENCE NUMERALS

| | |
|---|---|
| 10 fuel container outlet | 12 spout |
| 14 inner sleeve | 16 intermediate sleeve |
| 18 locking shoulders on sleeve 14 | 20 sliding sleeve |
| 22 resilient spout/tank seal | 24 biasing spring |

-continued

| | |
|---|---|
| 26 container seal | 28 check valve |
| 30 retaining washer | 32 sliding seal |
| 34 spout/tank seal retaining groove | 36 spout/tank seal retaining shoulder |
| 38 travel-limiting stop | 40 valve head |
| 42 valve head seal | 44 sleeve extension to valve head |
| 46 fuel flow port | 48 vapor/air passage |
| 50 valve seat | 52 fuel flow conduit |
| 54 tank opening | 56 tank seal contact location |
| 58 longitudinal ribs | 60 sleeve assembly |
| 62 locking shoulders on sleeve 16 | 64 sliding seal recess |
| 66 check valve retaining groove | 68 trapped volume of vapor and air |
| 70 fuel flow streams | 72 vapor and air escape spaces |
| 74 inner dirt shield sleeve | 76 outer dirt shield sleeve |
| 78 shutoff valve | 80 outer surface of conduit 52 |
| 82 inner surface of sleeve 20 | 84 fluid level in tank at shutoff |

DETAILED DESCRIPTION:—FIGS. 1, 2, 3, 4—PREFERRED EMBODIMENT

Figure 1:
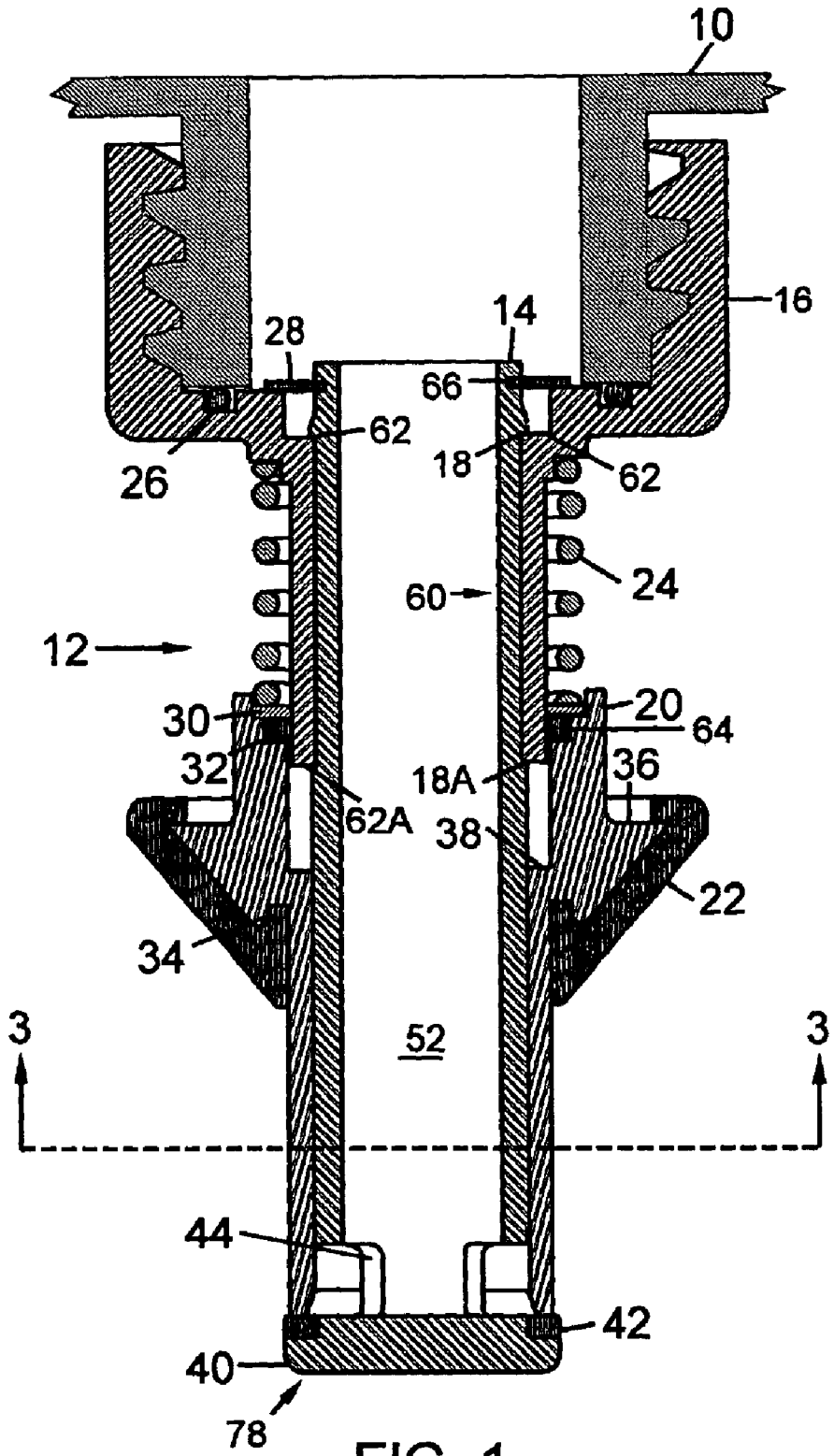
FIG. 1 illustrates the spout in the valve-closed state, with a longitudinal section through the ribs which center and guide the motion of the sliding sleeve on sleeve assembly 60 (FIG. 3), and which also provide the means for permanently locking the inner sleeve to said intermediate sleeve.
Figure 2:
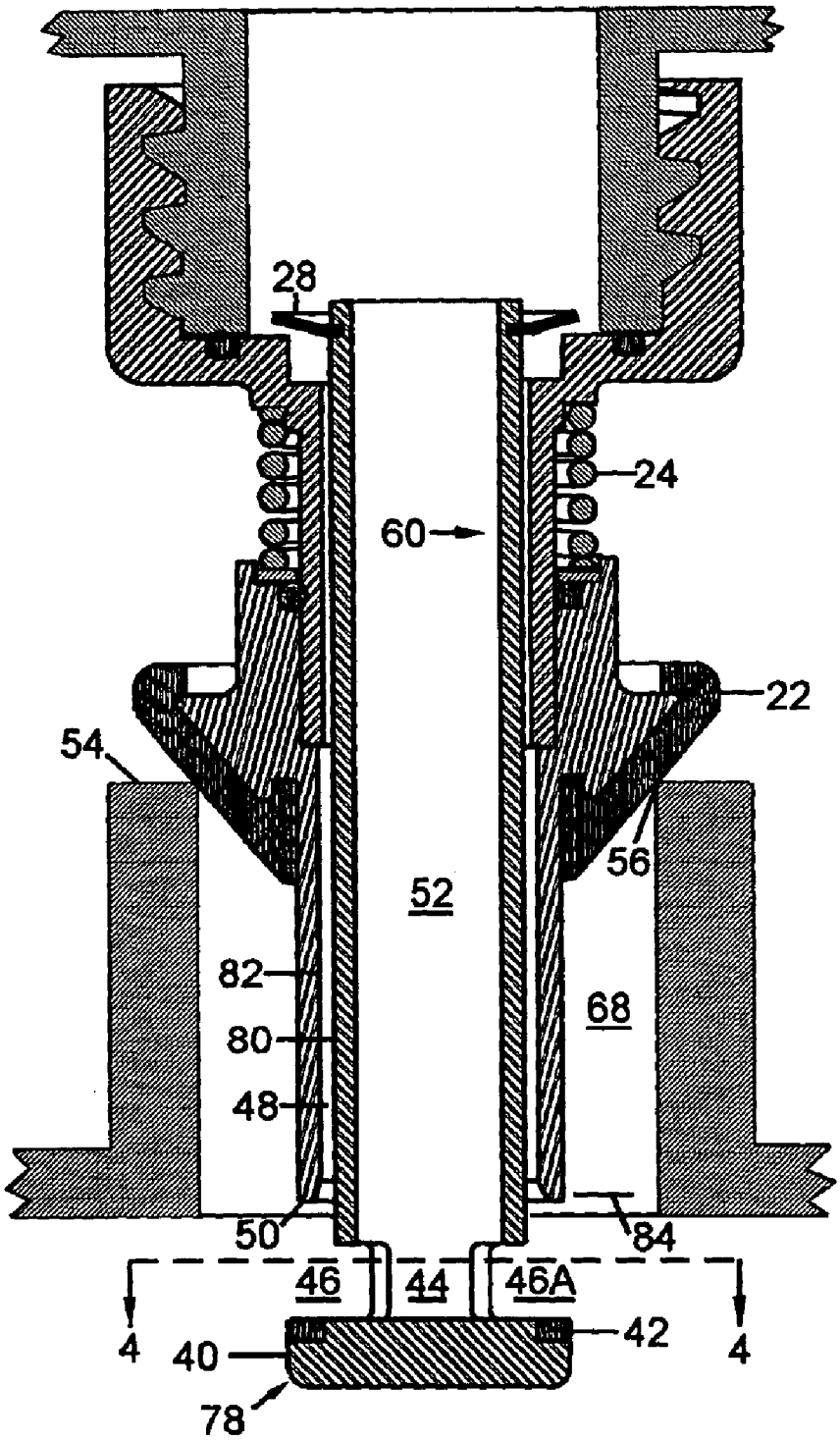
FIG. 2 illustrates a different longitudinal section taken 45 degrees from FIG. 1 illustrating the flow passages for the fuel and for the vapor and air when the spout is in the valve-open or refueling state.
Figure 3:
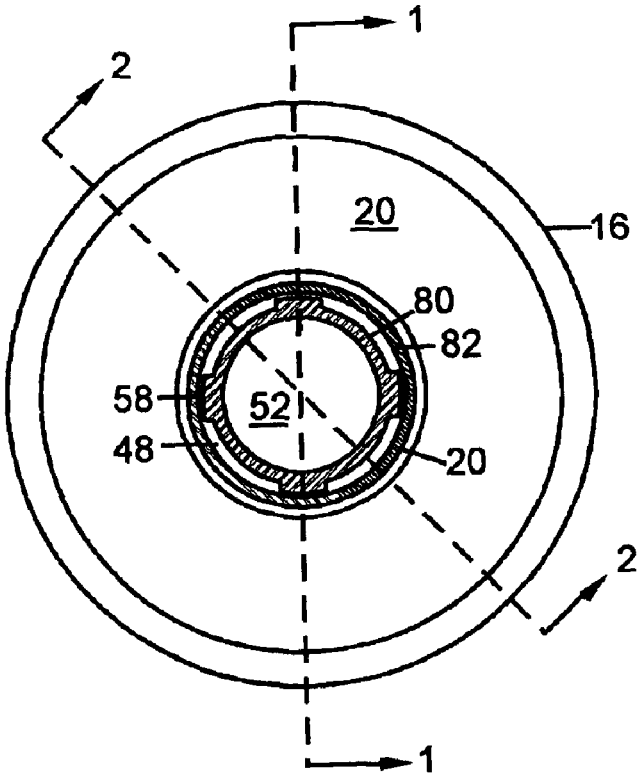
FIG. 3 illustrates a cross section through the fuel and vapor/air flow passages
Figure 4:
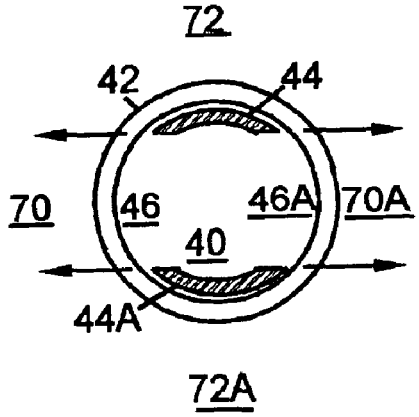
FIG. 4 illustrates a cross section through the fuel outlet ports of the fuel conduit.

A preferred embodiment of the spout of the present invention is illustrated in FIG. 1 (valve-closed state) and FIG. 2 (valve-open state) and in cross sectional views FIGS. 3 and 4. Spout 12 includes an intermediate sleeve 16 which is mounted onto a portable container 10 by means of screw threads, and sealed thereto by means of a compressible seal 26. Inner sleeve 14 is fixedly attached to intermediate sleeve 16 by a forced assembly, which causes shoulders 18 and 18A to snap into a locking relationship with mating shoulders 62 and 62A on intermediate sleeve 16 which are closer together by a slight amount than are shoulders 18 and 18A. Inner sleeve 14 and intermediate sleeve 16 thus become and remain a fixed assembly and operate thereafter as if made of one piece. This sub-assembly will hereafter be referred to as assembly 60, which includes a fuel conduit 52 and, at its distal end, provides fluid ports 46 and 46A and valve head 40. It should be noted that, when assembly 60 is locked, the process also preloads spring 24 and retains the entire spout assembly.

Sliding sleeve 20 slides in a telescoping relationship on assembly 60, and is guided on center by its fit with assembly 60 and the four longitudinal ribs 58 on said assembly. Ribs 58 are projections integral with the outer surface of assembly 60 and are best illustrated in the cross sectional view of FIG. 3. The use of four ribs is for illustration purposes and does not preclude the use of a different number.

Sliding sleeve 20 includes, at its distal end, a valve seat 50 which, in conjunction with valve head 40 and valve seal 42, constitutes a shutoff valve 78.

Vapor/air passageways 48 are provided by the spaces between ribs 58, the outer surface 80 of assembly 60 and the inner surface 82 of sliding sleeve 20. A check valve 28 is retained in groove 66 on sleeve 14 and serves to inhibit flooding of said vapor/air passageways by fuel descending from the container while refueling. Check valve 28 has very little resistance to upward vapor and air flow, and will open just enough to pass the available flow of vapor and air while causing the fuel flow to be confined to the fluid conduit 52.

Sliding seal 32 is retained in recess 64 by a washer 30 which is held in place by spring 24. The travel of outer sleeve 20, between valve-closed and valve-open states, is limited by the space between shoulders 18A and 38 in the valve-closed state, FIG. 1. Sliding sleeve 20 is biased by spring 24. This biasing load is supported by the valve head 40 and seal 42 on the distal end of assembly 60 during the valve-closed state and is transferred to tank seal 56, in the valve-open state, FIG. 2.

Sliding sleeve 20 is provided with a conical collar having an included cone angle, preferably less than 90 degrees, which is self-centering with respect to the tank opening 54. In the preferred embodiment, this conical surface mates with and supports a resilient spout/tank seal 22, which is mechanically retained by groove 34 and shoulder 36. Seal 22 has inner and outer conical surfaces which match the conical surface of sleeve 20. The maximum and minimum cone diameters of spout/tank seal 22 are selected to fit and seal the entire range of tank openings from large tractors to small string trimmers, thus it is seen that seal 56 can occur at different locations on the surface of seal 22 depending upon the diameter of the opening of the tank being refueled.

In the valve-open state illustrated in FIG. 2 fuel flows down fluid conduit 52 and exits through two ports 46 and 46A. Two extensions 44 and 44A of fluid assembly 60 support valve head 40.

A different view of fuel ports 46 and 46A is illustrated in FIG. 4 where it can be seen that the flow of fuel exiting through ports 46 and 46A is separated into two streams 70 and 70A by extensions 44 and 44A. This provides two open spaces 72 and 72A between fuel streams 70 and 70A to accommodate upward flow of vapor/air from the tank below.

PREFERRED MATERIAL AND MANUFACTURING METHODS

In the preferred embodiments sleeves 16, 14 and 20 can be injection-molded from plastic chosen from the many available polymers for the best combination of properties including total cost, wear resistance, rigidity, strength, weight, and fuel resistance. Washer 30 can be die-cut from flat plastic stock. These components can also be made from metal, but the properties listed above for plastic makes it the preferred choice unless there is some other consideration, i.e. the manufacturer's particular skills and production facilities. Spring 24 is a helical steel spring.

Check valve 28 is washer-shaped and can be die-cut from flat rubber stock. Seals 32, 42 and 26 can be injection-molded from fuel-resistant rubber. Spout/tank seal 22 can be injection molded from an abrasion-resistant rubber, such as urethane for example, with a suggested hardness of approximately 90 durometer. The harder rubber will tend to increase wear resistance, and reduce friction, thus easing its centering on the tank opening, while still providing enough resilience for sealing purposes. All of the resilient seal compounds will be resistant to ozone and gasoline. Seals 22 and 42 should also resist exposure to ultra violet light.

FIG. 5 ADDITIONAL EMBODIMENTS

Figure 5:
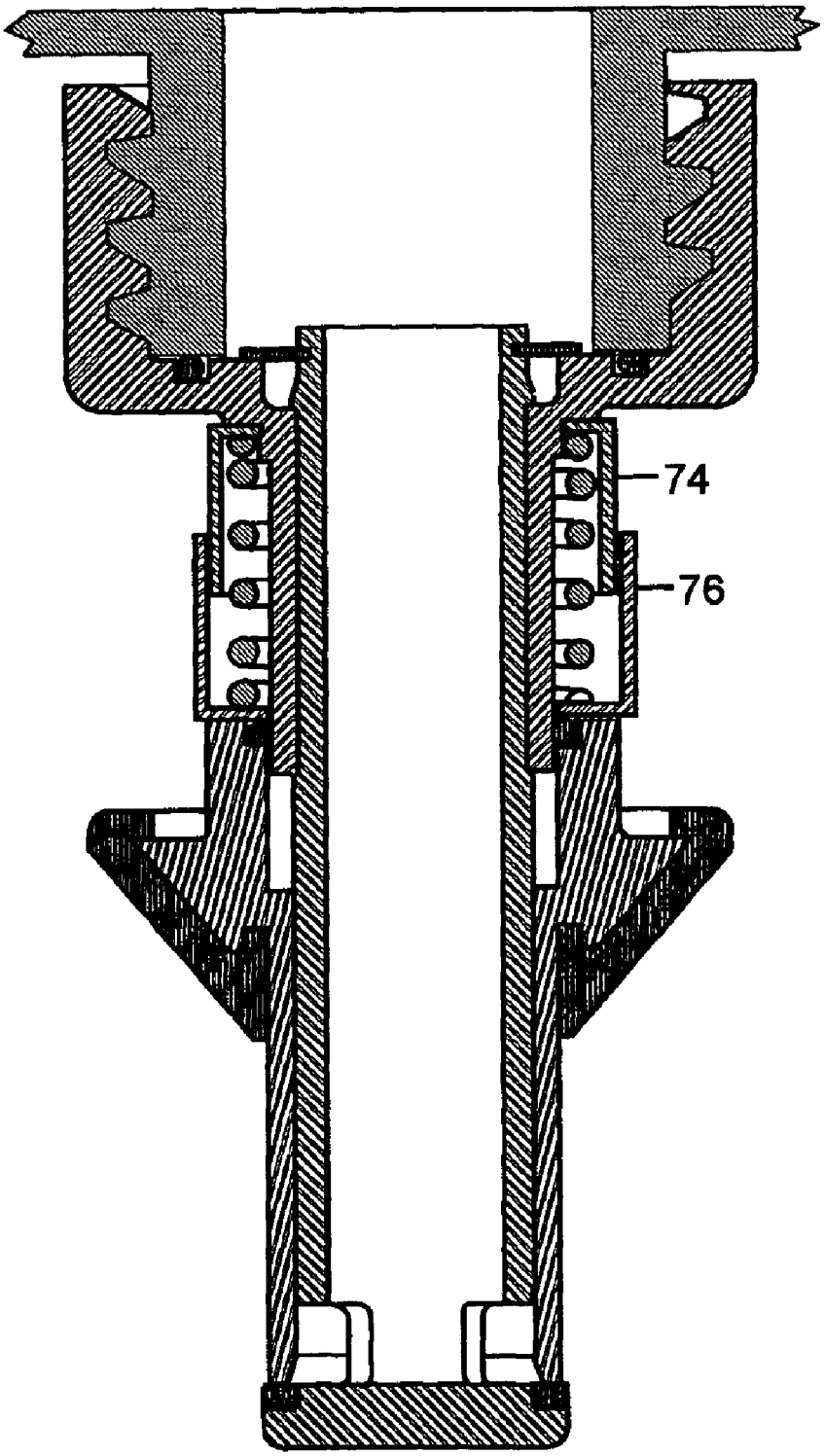
FIG. 5 Illustrates again the spout in the valve-dosed state showing the use of a shield to protect the sliding seal surfaces from possible contamination in dirty surroundings.

Telescoping dirt shields 74 and 76, FIG. 5, can be included to protect seal 32 and its sliding surface on sleeve 16 from abrasive contamination. These can also be injection-molded from a suitable plastic. Performance will not be improved by a dirt shield, but if it is found that abrasive contamination in dirty environments reduces the useful life of the spout, and is a common-enough occurrence, the additional cost may be justified.

While it is possible that outer sleeve 20, spout/tank seal 22, sliding seal 32, washer 30, and perhaps even valve seal 42 can be replaced by a one-piece molded part of resilient material, uncertainties regarding creep resistance under long-term exposure to high container-vapor pressures, strength limitations, elastic modulus, etc., remain to be answered before a choice of polymers can be predicted with confidence. The benefits of reinforced polymers and the abundance of available material properties may favor such a design following a reasonable amount of analysis and research. The illustrated method of locking inner sleeve 14 and intermediate sleeve 16 together to form assembly 60, is for illustration purposes and may be replaced by a different method, such as heat-upsetting, welding, chemical bonding, etc.

OPERATION:—FIGS. 1, 2, 3, 4

During storage and transportation, the spout 12 remains mounted on the portable fuel container 10, FIG. 1, which is normally in the upright position. Valve head 40, valve seal 42, and valve seat 50 together form shutoff valve 78, and are tightly closed by the applied load of biasing spring 24. Spring 24 is preloaded in assembly with sufficient force to provide a margin of safety against the highest internal vapor pressure anticipated in an un-vented container during high-temperature storage. Sliding seal 32 prevents leakage of vapor and air through the clearance between assembly 60 and sliding sleeve 20 during storage and use.

To fill the fuel tank the user introduces the distal end of the spout along with its resilient spout/tank seal 22 into the tank opening 54. Using reasonable care to align the seal in contact with said tank opening, the user then seats seal 22 more firmly by pushing down on container 10, creating a tight seal contact 56 with said tank opening. This forces assembly 60 downward relative to sliding sleeve 20, opening shutoff valve 78, and fuel ports 46 and 46A, and transfers the biasing load of spring 24 to the tank seal contact 56. The downward movement of assembly 60 stops when shoulder 62 bottoms on outer sleeve shoulder 38. In this position vapor/air flow passages 48 are also open. Fuel flows freely through fluid conduit 52 and ports 46 and 46A into the tank, and vapor and air flow freely past check valve 28 into the container 10.

When the fuel level 84 reaches valve seat 50 it blocks the flow of vapor and air to said container, and traps a confined vapor and air volume 68 between tank seal 56, tank fuel level 84 and the interior walls of the tank opening 54. Vapor and air volume 68 acts like an air cushion and absorbs the momentum of the fuel, quickly stopping the flow and creating a static pressure equilibrium between said vapor and air volume pressure and the head of fuel remaining in the container and spout.

The application of Boyle's gas law, explained above, establishes that vapor and air volume 68, at this state of static equilibrium, will be reduced by only 2 to 3 percent, depending upon the head of fuel remaining in the container. This allows the static fuel level to rise only a negligible amount above valve seat 50.

While spout 12 is being lifted away from the tank, biasing spring 24 keeps tank seal 56 tight against tank opening 54 until shutoff valve 78 closes, with valve seal 42 and valve head 40 being brought to rest against valve seat 50 under the valve-closed biasing spring load. This seals both said fuel and said vapor and air within the container. This completes the refueling process.

ADVANTAGES

From the description above a number of advantages of my No-Spill, Vapor-Recovery Fuel Spout become evident:

1. Complete vapor recovery will be achieved, with the spout/tank seal completely isolating the fuel tank from the atmosphere during the entire refueling process.
2. Fuel spillage will be eliminated because the small vapor/air volume, trapped and sealed, above the fuel in the tank, requires only a very small amount of compression, achieved quickly and automatically by the head of fuel in the container, to quickly stop the fuel flow.
3. The more rapid fuel flow, which will be even more rapid than with conventional fuel spouts, will increase user convenience.
4. The reliable elimination of fuel spillage will improve air quality and increase user confidence.
5. With a container which has been stored in a hot environment or left standing in the sun, the expected surge of fuel into the tank, caused by the high container vapor pressure, will be contained by the spout/tank seal, making it unnecessary to vent the vapor and air to the atmosphere prior to starting the refueling process.
6. The conical spout/tank seal will fit and seal the range of tank opening sizes commonly found in off-road equipment.
7. The biasing spring serves two functions instead of just one. It keeps the shutoff valve tightly closed during storage and transportation and then, while refueling, it keeps the fuel tank seal tightly sealed during the refueling process.

CONCLUSION, RAMIFICATIONS, AND SCOPE

Accordingly, the reader will see that the present invention will improve both the convenience and confidence of the user, and will contribute to air quality-control measures. The latter property will be appreciated by those states which are in the forefront in their efforts to improve air quality in their communities, and also by other states which are expected to follow in the near future. In all cases, the convenience and confidence provided by the present invention, and the annoyances frequently reported by users of currently-available fuel spouts, will be an attractive inducement to its purchase and use. The fact that the high fuel-flow rate will complete the refueling function more quickly will be a satisfying feature to the user and will increase sales and marketing features.

Although the description above contains many specificities, these should not be construed as limiting the scope of the invention but as merely illustrating some of the presently preferred embodiments of this invention. For example, other means for mechanically, or chemically, retaining spout/tank seal 22 may be used and a wide range of resilient compounds are available for its construction. The o-ring seal may be replaced by a lip-type seal. Alternate methods of permanently attaching the inner and intermediate sleeves are available. Choices such as these are engineering decisions and can be made without violating the principles of the invention.

Thus the scope of the invention should be determined by the appended claims and their legal equivalents, rather than the examples given.

I claim:

1. A vapor recovery spout for a portable container, the spout being insertable in a fuel tank opening and including:

an inner sleeve member attached to the container and defining a fuel flow passage, the inner sleeve having an outward end portion that defines an outlet port for the fuel flow passage, a sliding sleeve member mounted for axial sliding movement on the inner sleeve member, from a normal extended position to a retracted position in response to insertion of the spout into the opening, the sliding sleeve member having a radially extending annular seal to seal the opening when the spout is inserted, vapor recovery passage means in the spout, the passage means having an inlet at the outward end of the spout and an outlet in the container, the sliding sleeve member being adapted to close the outlet port and the inlet of the vapor recovery passage means when in its normal extended position and to open the outlet port and the inlet for the vapor recovery passage when in its retracted position, and spring means biasing the sliding sleeve member to its normal extended position, characterized in that the vapor recovery passage means comprises axially extending passageways defined between the exterior surface of the inner sleeve member and the interior surface of the sliding sleeve member.

2. A vapor recovery spout as defined in claim 1 further characterized by a check valve for closing the outlet of the vapor recovery passage means, the valve comprising a flexible annular element secured to the inward end of the inner sleeve member and extending radially outward therefrom, the annular element being movable between a normally closed position, closing the outlet of the vapor recovery passage means and an axially flexed, open position, to permit vapor to flow into the container.

3. The spout of claim 1 wherein the fuel container is not vented.

4. The spout of claim 1 wherein the sliding sleeve incorporates an annular flange on its outer surface thereby providing means for seating and sealing the sliding sleeve against the tank opening and thereby transferring the spring forge acting on the sliding sleeve to the tank opening as the user pushes the spout into the tank opening thereby opening both the shutoff valve and the vapor recovery passage means.

5. The spout of claim 4 wherein the flange is provided with a resilient surface facing and seating on the tank opening, the resilient facing providing sufficient yield to compensate for misalignment as the spout is pushed into the tank opening.

6. The spout of claim 4 wherein the spring force biasing the sliding sleeve provides sufficient initial resistance to internal tank pressure acting against the flange to contain any sudden initial surges of fuel into the tank when the container has an internal pressure as high as 10 PSIG thereby eliminating the need to vent the container vapor into the atmosphere prior to filling the tank.

7. The spout of claim 1 wherein the outer surface of the inner sleeve member incorporates a plurality of longitudinal ribs thereby ensuring concentricity between the inner sleeve member and the sliding sleeve member, the spaces between the ribs forming a plurality of vapor passage means.

8. The spout of claim 7 wherein the vapor recovery passage means extend into a contiguous annular space formed in the inner sleeve the vapor recovery passage means providing sufficient flow capacity to ensure a suitable rate of flow of vapor from the tank to the container to maintain the pressure within the portable container nearly equal to the pressure within the tank thereby allowing rapid flow of fuel from the spout to the tank.

9. The spout of claim 8 wherein the discharge end of the vapor recovery passage means is closed by means of a flexible disk, the flexible disk being contained at its inner diameter in an annular groove provided in the inner sleeve, the flexible disk then providing a barrier over which the fuel is directed into the fuel flow passage of the inner sleeve member while excluding the fuel from the vapor recovery passage means when the container is tipped to deliver fuel to the tank, the flexible disk then lifting with suitable ease to allow said suitable rate of flow of the vapor displaced from the tank into the container.

10. The spout of claim 7 wherein the outer end portion of the sliding sleeve has an interior diameter which fits slidably over the longitudinal ribs on the inner sleeve member while the remaining portion of the sliding sleeve has an interior diameter that fits slidably over a larger exterior diameter on the inner end of the inner sleeve, the shoulders formed on both the inner sleeve and the sliding sleeve this geometry then engaging when the shutoff valve is opened, the fit between the sliding sleeve and the larger exterior diameter of the inner sleeve being provided with sealing means to prevent leakage of fuel or vapor into the atmosphere.

11. The spout of claim 1 wherein the inlet to the vapor passageways is positioned to allow the rising fuel level in the tank opening to block the vapor passageways at a suitable level above the fuel discharge outlet of the spout thereby preventing further displacement at vapor from the tank, the remaining vapor sealed within the tank opening then being compressed by the force of the head of fuel remaining in the container and thereby stopping further fuel flow into the tank.

12. The spout of claim 11 wherein the spring biasing the sliding sleeve maintains the compressed vapor pressure while the spout is removed from the tank opening thereby preventing fuel flow until the shutoff valve closes.

* * * * *